US008528533B2

(12) United States Patent
Kishi et al.

(10) Patent No.: US 8,528,533 B2
(45) Date of Patent: Sep. 10, 2013

(54) PLUGHOLE WATERPROOFING DEVICE FOR ENGINE

(75) Inventors: Shoji Kishi, Tsurugashima (JP); Takahiro Kajihara, Tsurugashima (JP); Makoto Kurahashi, Wako (JP); Gakuji Moriya, Wako (JP)

(73) Assignees: Toyo Denso Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 395 days.

(21) Appl. No.: 12/877,406

(22) Filed: Sep. 8, 2010

(65) Prior Publication Data

US 2011/0083628 A1 Apr. 14, 2011

(30) Foreign Application Priority Data

Oct. 9, 2009 (JP) ..... 2009-235660

(51) Int. Cl.
*H01F 38/12* (2006.01)
*F02P 3/02* (2006.01)

(52) U.S. Cl.
USPC ..... 123/635; 123/647

(58) Field of Classification Search
USPC ..... 123/608, 634, 635, 647, 169 PA, 123/143 C, 41.32
See application file for complete search history.

(56) References Cited

U.S. PATENT DOCUMENTS

| | | | | | |
|---|---|---|---|---|---|
| 4,514,712 | A * | 4/1985 | McDougal | 336/96 |
| 5,462,023 | A * | 10/1995 | Furuya | 123/143 C |
| 5,549,082 | A * | 8/1996 | Kobayashi | 123/143 C |
| 5,592,911 | A * | 1/1997 | Komatsu | 123/143 C |
| 5,618,193 | A * | 4/1997 | Nakajima et al. | 439/125 |
| 5,628,298 | A * | 5/1997 | Murata | 123/635 |
| 5,799,633 | A * | 9/1998 | Miller | 123/143 C |
| 5,870,012 | A * | 2/1999 | Sakamaki et al. | 336/107 |
| 5,878,706 | A * | 3/1999 | Akamatsu | 123/143 C |
| 6,227,186 | B1 * | 5/2001 | Seidl et al. | 123/634 |
| 6,977,572 | B2 * | 12/2005 | Kawai et al. | 336/90 |
| 7,013,883 | B2 * | 3/2006 | Shimada et al. | 123/634 |
| 7,629,869 | B2 * | 12/2009 | Fujiyama | 336/90 |

FOREIGN PATENT DOCUMENTS

| | | | |
|---|---|---|---|
| JP | 10-125442 | A | 5/1998 |
| JP | 2006-118360 | A | 5/2006 |
| JP | 2007-109867 | A | 4/2007 |
| JP | 2008-060188 | A | 3/2008 |
| JP | 2008-060228 | A | 3/2008 |
| JP | 2009-002215 | A | 1/2009 |
| JP | 2009002215 | A | 1/2009 |
| JP | 2009-212142 | A | 9/2009 |

* cited by examiner

*Primary Examiner* — Thomas Moulis
(74) *Attorney, Agent, or Firm* — Carrier Blackman & Associates, P.C.; Joseph P. Carrier; William D. Blackman

(57) ABSTRACT

In a plughole waterproofing device for an engine, a coil case is fitted onto the ignition coil that is accommodated in a plughole of an engine, and an upper portion of the case protruding above the engine is provided with a longitudinal air path extending upward from a lower end thereof communicating with the plughole and a vent hole communicating with an upper end portion of the air path and opened to ambient air. A cover wall hanging while surrounding the vent hole is continuously provided on the case upper portion, and an air chamber is formed inside the cover wall, the vent hole being opened in an upper portion of the air chamber, and an opening face being formed at an entire bottom of the air chamber opening toward the engine.

5 Claims, 10 Drawing Sheets

PLUGHOLE WATERPROOFING DEVICE FOR ENGINE

BACKGROUND OF THE INVENTION

1. Field of the Invention

The present invention relates to an improvement of a plughole waterproofing device for an engine in which a coil case for covering an ignition coil is fitted onto the ignition coil that is accommodated, together with an ignition plug, in a plughole opened to an upper surface of an engine, and in which a longitudinal air path and a vent hole are provided in a case upper portion, protruding above the engine, of the coil case, the longitudinal air path extending upward from a lower end portion of the case upper portion communicating with the plughole, the vent hole communicating with an upper end portion of the longitudinal air path and being opened to ambient air.

2. Description of Related Art

Such a plughole waterproofing device for an engine is already known as disclosed, for example, in Japanese Patent Application Laid-open No. 2008-60188.

In the plughole waterproofing device for an engine disclosed in Japanese Patent Application Laid-open No. 2008-60188 described above, a vent hole is provided in a lower end portion of an upper portion of a case, and a water holding chamber extending upward from an inner end of the vent hole and communicating with an upper end portion of a longitudinal air path is provided in the upper portion of the case. This allows a plughole to breathe as the engine temperature increases or decreases. In addition, the device prevents the plughole from receiving water by holding, in the water holding chamber, water sucked by a pressure decrease in the plughole involved in the decrease of the engine temperature even when the vent hole sinks in a pool formed on an upper surface of the engine. In this regard, the pool may be formed due to: splashed water entering an engine room during driving on a flooded road or a road having a puddle; rainwater entering the engine room during driving on a rainy day; washing water entering the engine room at the time of washing a vehicle; or the like.

In the conventional plughole waterproofing device described above, however, the vent hole is provided in a small size at the lower portion of the water holding chamber. For this reason, when water in the pool drains away, throttle resistance of the vent hole hinders good drainage from the water holding chamber. Accordingly, if the engine repeatedly receives water before water drains away from the water holding chamber completely, the received water enters the vent hole, so that the amount of water in the water holding chamber is increased. If the plughole breathes in such a situation, the plughole might suck water from the water holding chamber.

SUMMARY OF THE INVENTION

The present invention has been made under these circumstances. An object of the present invention is to provide a simple-structured plughole waterproofing device for an engine, which is capable of effectively preventing water intrusion into a vent hole and thus preventing a plughole from receiving water even when the engine receives water repeatedly.

In order to achieve the object, according to a first feature of the present invention, there is provided a plughole waterproofing device for an engine in which a coil case for covering an ignition coil is fitted onto the ignition coil that is accommodated, together with an ignition plug, in a plughole opened to an upper surface of an engine, and in which a longitudinal air path and a vent hole are provided in a case upper portion, protruding above the engine, of the coil case, the longitudinal air path extending upward from a lower end portion of the case upper portion communicating with the plughole, the vent hole communicating with an upper end portion of the longitudinal air path and being opened to ambient air, wherein the vent hole is provided in an upper portion of the case upper portion, a cover wall is continuously provided on the case upper portion, the cover wall hanging toward the upper surface of the engine while surrounding the vent hole, and an air chamber is formed inside the cover wall, the vent hole being opened in an upper portion of the air chamber, an opening face being formed at an entire bottom of the air chamber in such a manner as to open toward the engine.

According to the first feature of the present invention, the vent hole is provided in the upper portion of the case upper portion of the coil case, and the cover wall hanging toward the upper surface of the engine and surrounding the vent hole is continuously provided on the case upper portion. Thus, even though the case upper portion receives water, the cover wall prevents the water from entering the vent hole.

In addition, the air chamber is formed inside the cover wall. In the air chamber, the vent hole is opened in the upper portion of the air chamber, and the entire bottom forms the opening face which is opened toward the engine. Thus, when a pool is formed on the upper surface of the engine and closes the opening face of the air chamber, air inside the air chamber stops water level from rising. This can prevent the water from entering the vent hole.

On top of that, the entire bottom of the air chamber forms the opening face which is opened toward the engine. When the water in the pool drains away, water in the air chamber simultaneously flows through the opening face without any resistance and drains together with the water in the pool. Thereby, the air chamber can be evacuated immediately. Accordingly, even if the plughole takes air with the decrease of the temperature of the engine E, it is possible to prevent the plughole from sucking water through the vent hole.

According to a second feature of the present invention, in addition to the first feature, the air chamber is formed in such a manner that a cross-sectional area of the air chamber is gradually increased toward the opening face.

According to the second feature of the present invention, the cross-sectional area of the air chamber is gradually increased toward the opening face. This allows water to flow from the air chamber more swiftly. Moreover, mold releasing from the air chamber can be facilitated at the time of forming the coil case.

According to a third feature of the present invention, in addition to the first feature, a swelled chamber to which an inner end of the vent hole is opened and a throttle hole through which the swelled chamber communicates with the upper end portion of the longitudinal air path are provided in the upper portion of the case upper portion, so that the vent hole and the longitudinal air path are communicated with each other.

According to the third feature of the present invention, even if water drops having momentum and entering the air chamber pass through the vent hole, a pressure decrease effect in the swelled chamber attenuates the momentum of the water drops, thereby reliably preventing the water drops from entering the longitudinal air path through the throttle hole.

According to a fourth feature of the present invention, in addition to the third feature, a mold-release hole for forming the swelled chamber is provided in the case upper portion and closed by a closure body.

According to the fourth feature of the present invention, when the coil case is formed, the vent hole, the swelled chamber, and the throttle hole can be formed simultaneously with the air chamber and the longitudinal air path. On top of that, the mold-release hole for forming the swelled chamber can be closed with the closure body.

According to a fifth feature of the present invention, in addition to the first feature, an annular sealing member placed into close contact with an upper opening portion in the plughole is fitted into the coil case, an outer annular path, an outer longitudinal groove, an inner annular path, and an inner longitudinal groove are formed between the sealing member and the coil case, so that the longitudinal air path and the plughole are communicated with each other, the outer annular path communicating with a lower end of the longitudinal air path, the outer longitudinal groove extending upward from the outer annular path, the inner annular path being connected to an upper end portion of the outer longitudinal groove and arranged inward of the outer annular path, the inner longitudinal groove communicating between the inner annular path and the plughole, at a position different from that of the outer longitudinal groove, on a circumference of the coil case.

According to the fifth feature of the present invention, the communicating path between the longitudinal air path and the plug hole forms a complicated maze having many bent portions. Even though moisture is contained in the outside air which is taken by the plughole at the time of breathing, the moisture can be separated from the air because the outside air collides with the many bent walls in the maze. This can prevent the moisture from entering the plughole.

In addition, the outer longitudinal groove which is continuous to the plughole side extends upward from the outer annular path communicating with the lower end portion of the longitudinal air path. In the unlikely event that water passing through the air chamber enters the longitudinal air path, the water is held by the outer annular path. Thereby, it is possible to prevent the water from moving to the plughole side.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be described below based on a preferred embodiment of the present invention shown in the attached drawings.

Figure 1:
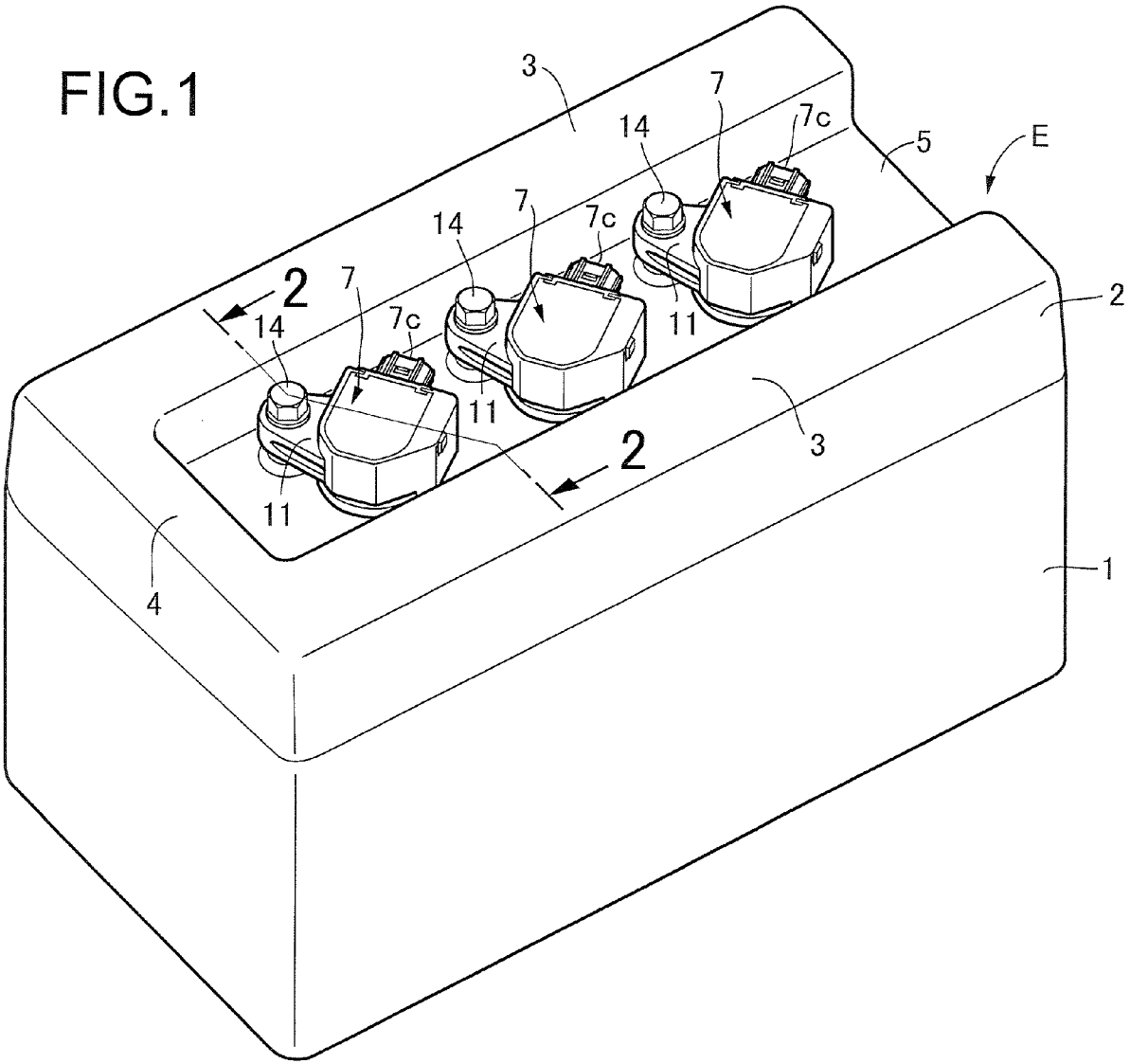
FIG. 1 is a perspective view of a DOHC type engine for an automobile including a plughole waterproofing device according to an embodiment of the present invention.

Firstly, in FIG. 1, two protrusions 3, 3 and a link protrusion 4 which links one end portions of the respective protrusions 3, 3 are formed on an upper surface of a head cover 2 joined to a top surface of a cylinder head 1 in a DOHC type engine E for an automobile. The protrusions 3, 3 extend in parallel to each other and respectively correspond to two valve camshafts (unillustrated) in the cylinder head 1. Multiple ignition coils 7 are attached to the head cover 2, in a recessed groove 5 defined between the two protrusions 3, 3.

Figure 2:
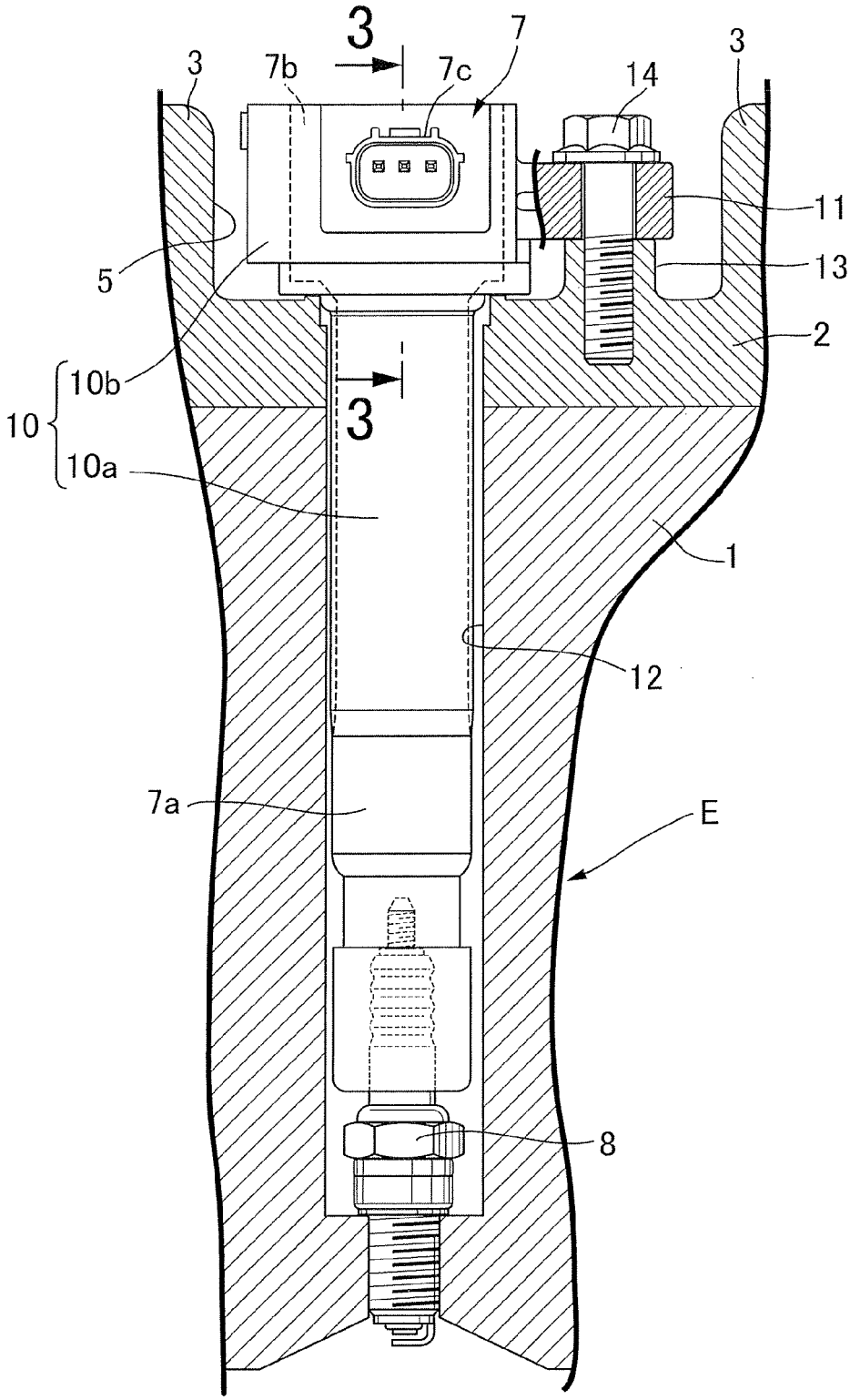
FIG. 2 is a cross-sectional view taken along a line 2-2 in FIG. 1.
Figure 3:
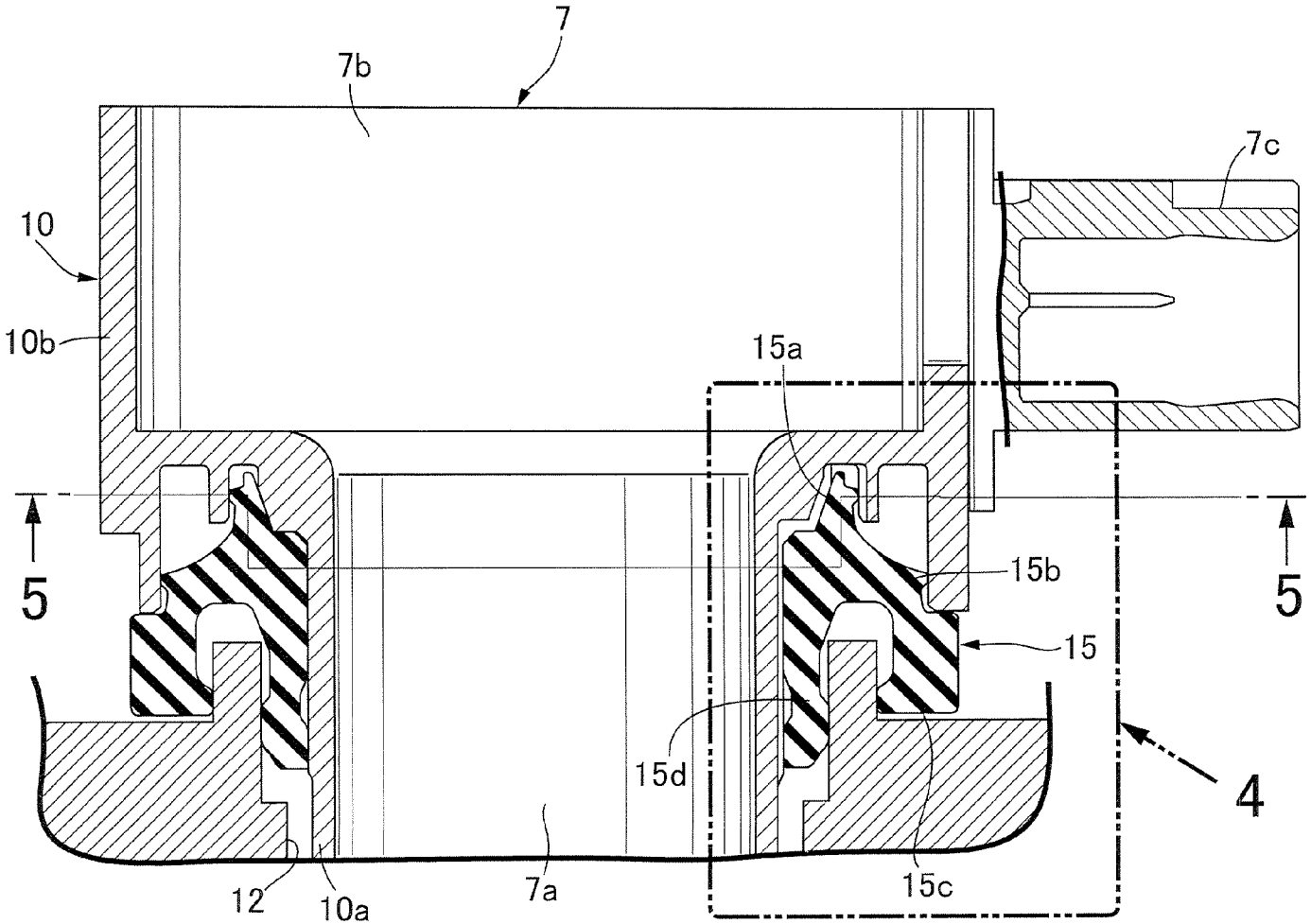
FIG. 3 is an enlarged cross-sectional view taken along a line 3-3 in FIG. 2.

As shown in FIGS. 1 to 3, an ignition plug 8 standing upright with an electrode thereof facing a combustion chamber in a cylinder is screwed in the cylinder head 1. The ignition coil 7 is mechanically and electrically connected to an upper end portion of the ignition plug 8. The ignition coil 7 includes a columnar portion 7*a* connected to the ignition plug 8 and an expanded head portion 7*b* integrally continuous with an upper end of the columnar portion 7*a*. A connector 7*c* is integrally provided to the expanded head portion 7*b* so as to protrude from a side surface of the expanded head portion 7*b*. A coil case 10 made of a synthetic resin is fitted onto the ignition coil 7, except for a portion around the connector 7*c*. The coil case 10 airtightly and watertightly covers outer peripheral surfaces of the columnar portion 7*a* and the expanded head portion 7*b*. A bracket 11 protruding from a side different from the connector 7*c* side is integrally formed on an upper end portion of the coil case 10.

The ignition plug 8 and the columnar portion 7*a* of the ignition coil 7 are accommodated in a corresponding one of a series of cylindrical plugholes 12 which are provided in the cylinder head 1 and the head cover 2 in such a manner as to be opened toward a bottom surface of the recessed groove 5. The connector 7*c* and the bracket 11 are arranged in the recessed groove 5. The bracket 11 is fixedly attached to an attachment boss 13 with a bolt 14, the boss 13 being provided to protrude from the bottom surface of the recessed groove 5.

A plughole waterproofing device of the present invention is configured to allow the plughole 12 to breathe and to prevent intrusion into the plughole 12 of water splashed from a road surface, rainwater, car-washing water or the like entering into an engine room. A description thereof is given below.

Figure 4:
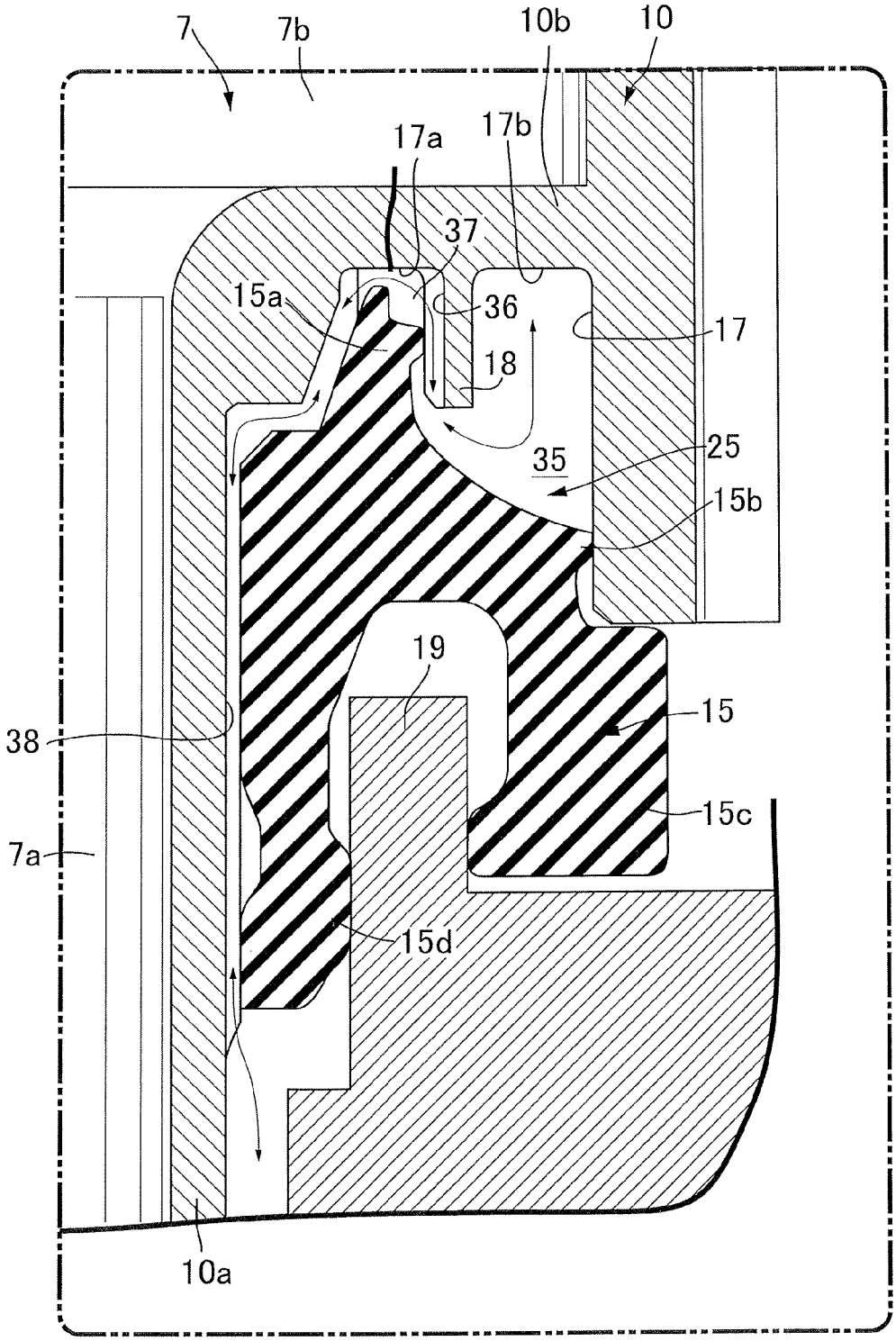
FIG. 4 is an enlarged view of a part shown by an arrow 4 in FIG. 3.
Figure 5:
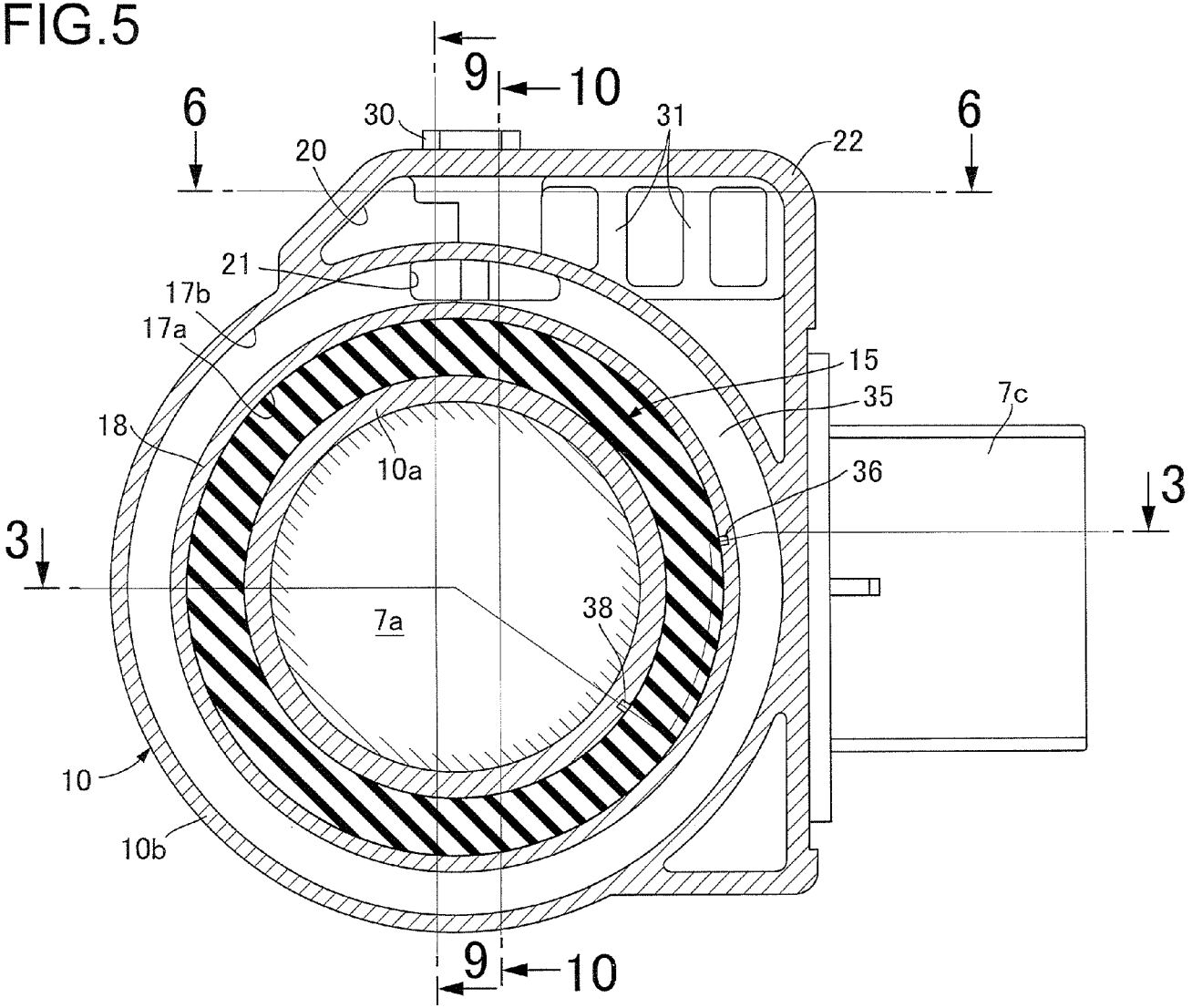
FIG. 5 is a cross-sectional view taken along a line 5-5 in FIG. 3.
Figure 6:
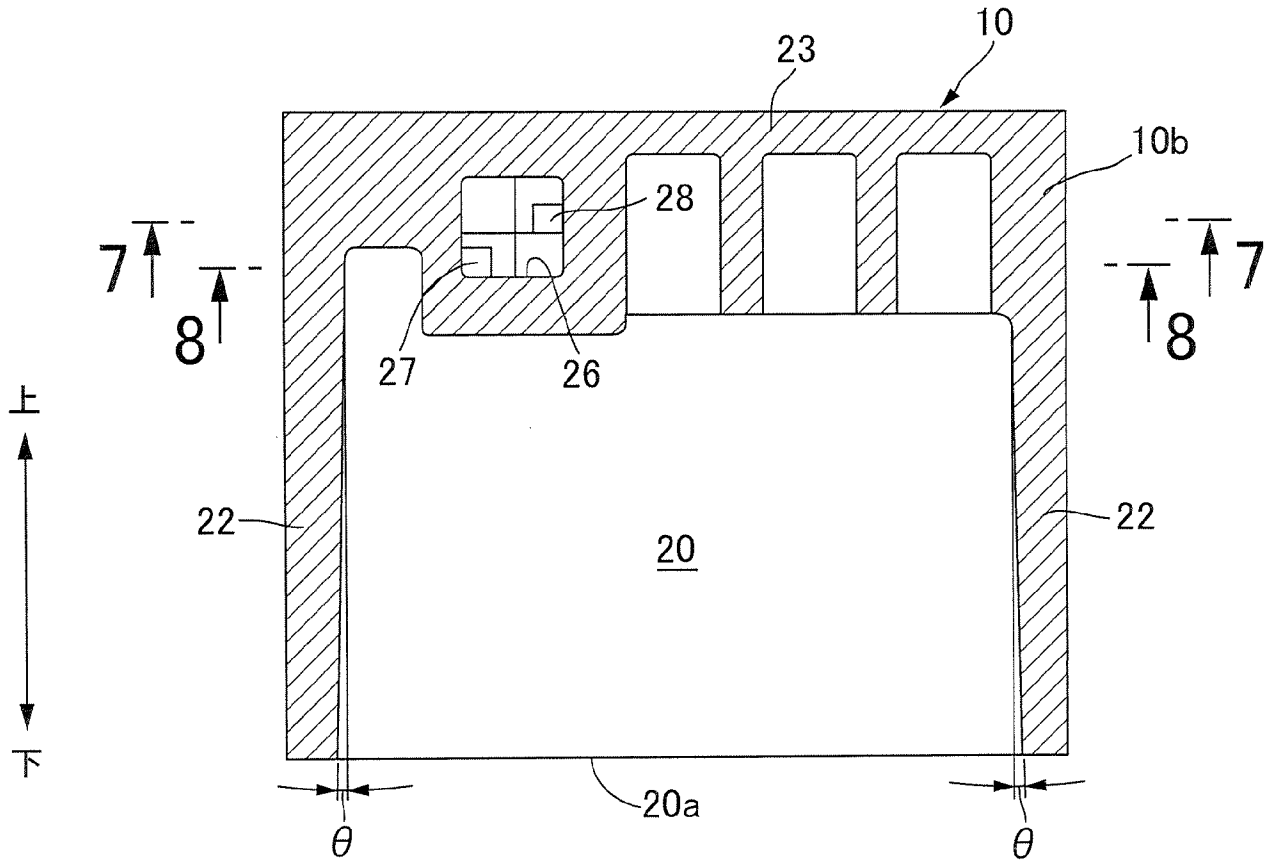
FIG. 6 is a cross-sectional view taken along a line 6-6 in FIG. 5.
Figure 7:
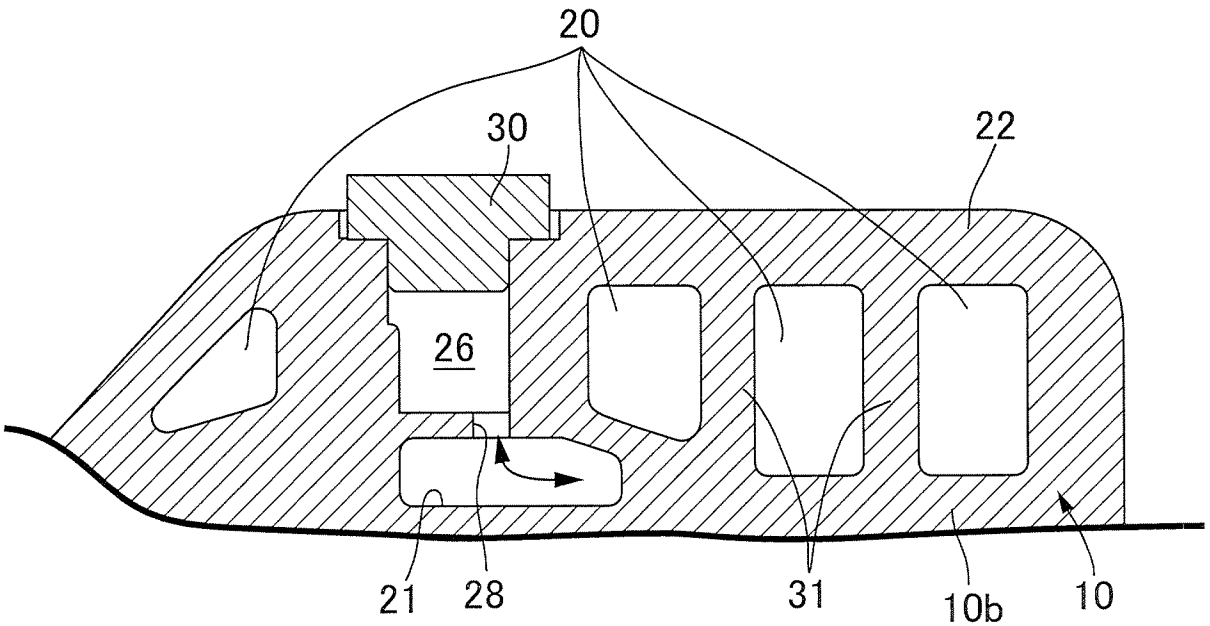
FIG. 7 is a cross-sectional view taken along a line 7-7 in FIG. 6.
Figure 8:
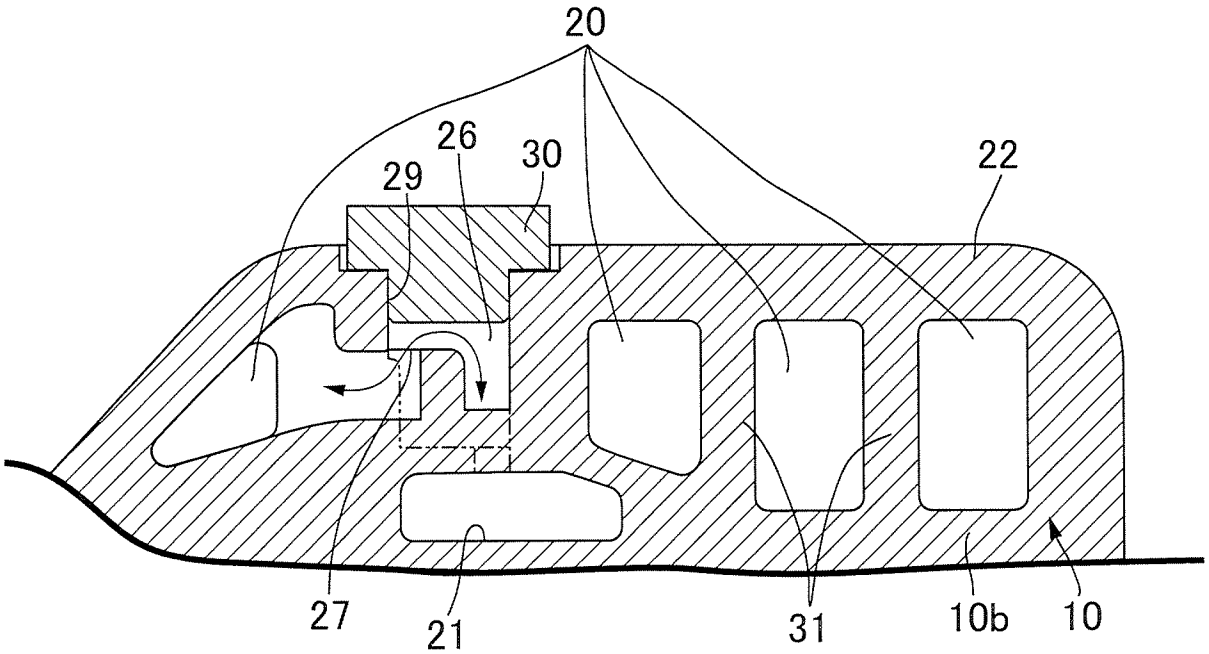
FIG. 8 is a cross-sectional view taken along a line 8-8 in FIG. 6.
Figure 9:
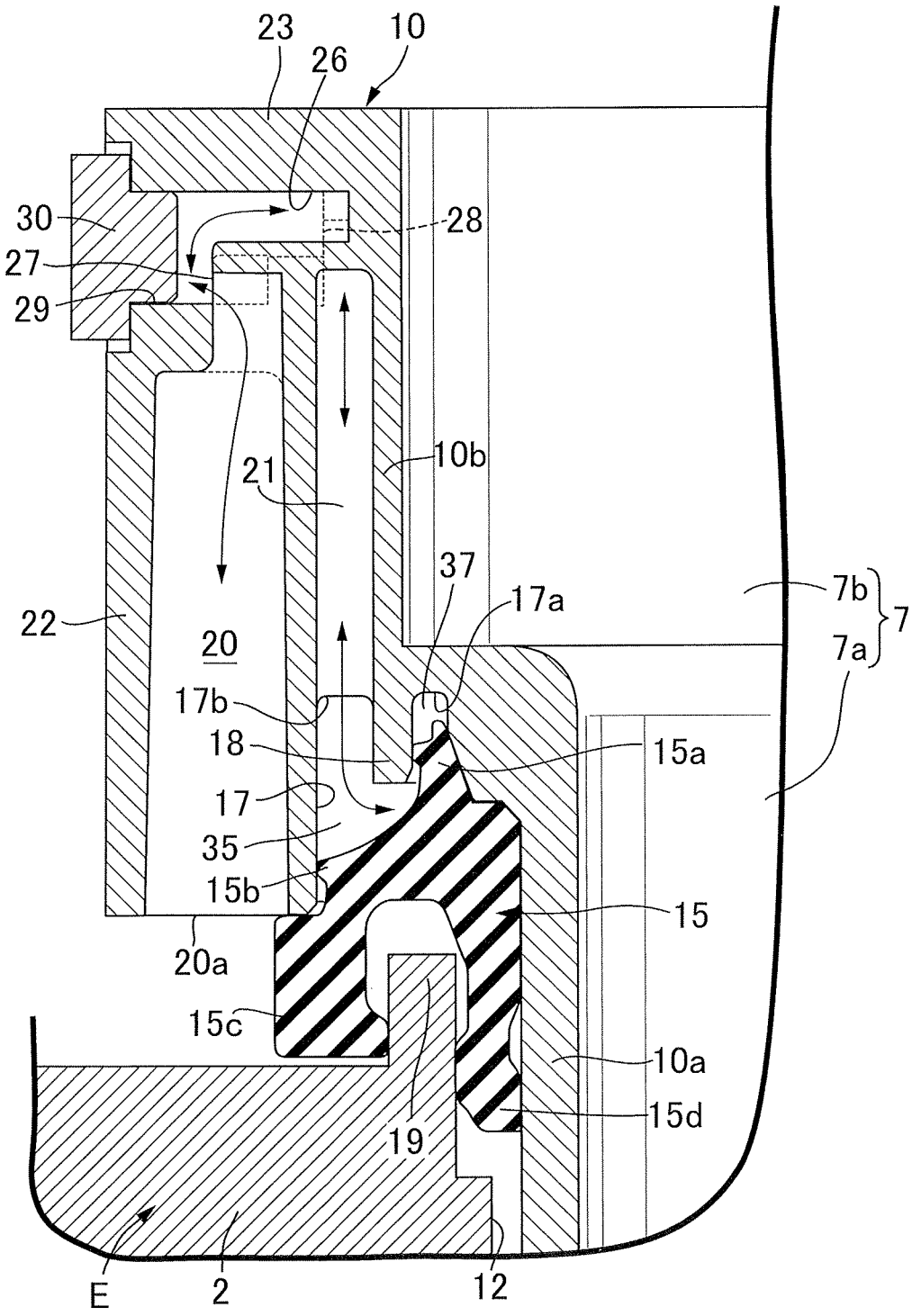
FIG. 9 is a cross-sectional view taken along a line 9-9 in FIG. 5.
Figure 10:
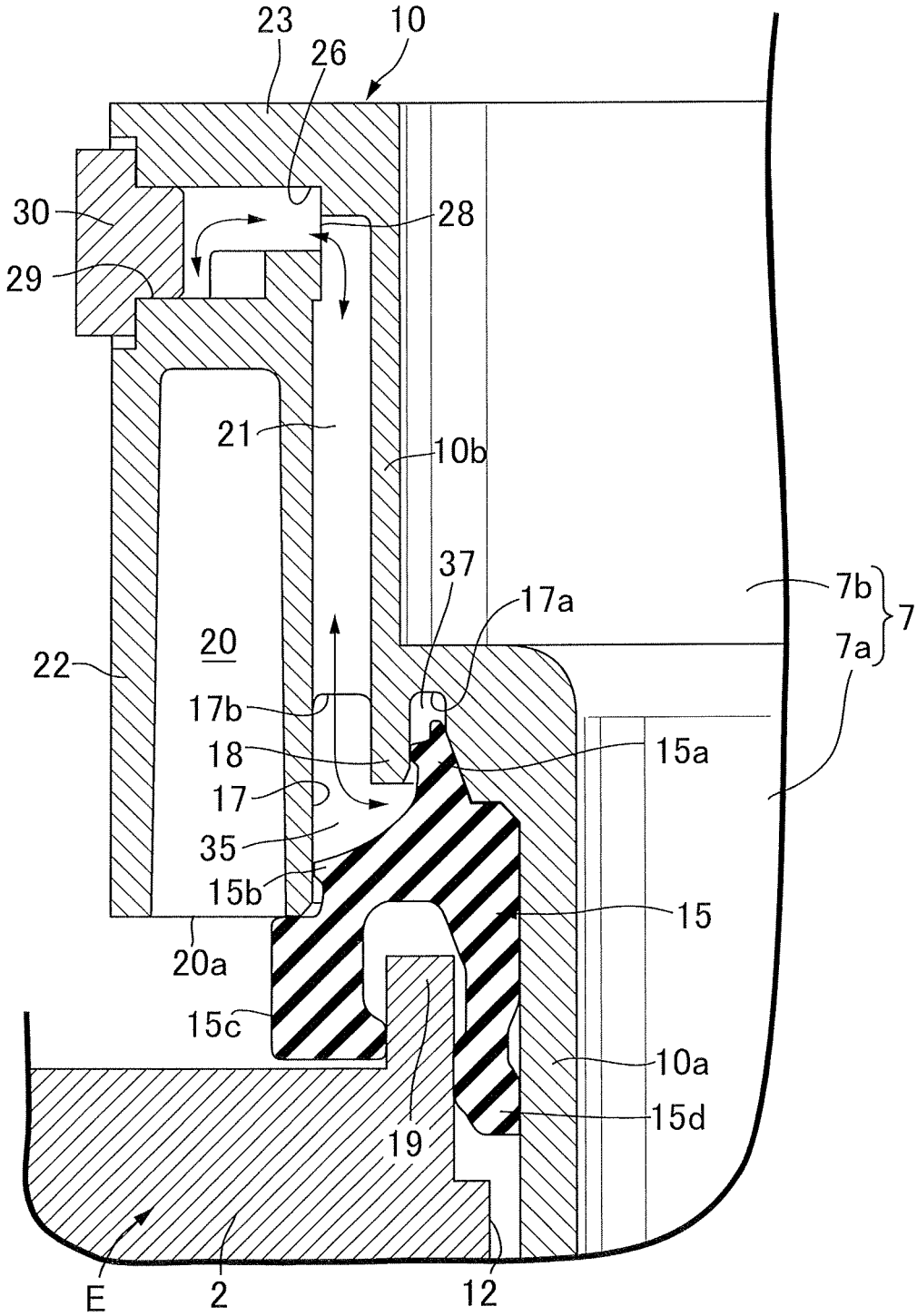
FIG. 10 is a cross-sectional view taken along a line 10-10 in FIG. 5.

In FIGS. 2 to 4, the coil case 10 made of a synthetic resin is integrally formed with a case lower portion 10*a* covering the columnar portion 7*a* of the ignition coil 7 and a case upper portion 10*b* covering the expanded head portion 7*b*. An annular sealing member 15 made of an elastic member such as rubber is fitted to a portion between the case lower portion 10*a* and the case upper portion 10*b*. As clearly shown in FIG. 4, the sealing member 15 includes an annular first lip portion 15*a* facing upward, an annular second lip portion 15*b* protruding from a base of the first lip portion 15*a* outward around the outer periphery thereof, an annular third lip portion 15*c* protruding downward from a lower portion of the second lip portion 15*b*, and an annular fourth lip portion 15*d* protruding downward from a lower portion of the first lip portion 15*a* and arranged inward of the third lip portion 15*c*.

A large annular groove 17 opened downward and surrounding the case lower portion 10*a* is formed in a lower end surface of the case upper portion 10*b*. An upper portion of the large annular groove 17 is divided into a pair of inner and outer small annular grooves 17*a*, 17*b* by an annular separation wall 18 protruding from a ceiling surface of the large annular groove 17.

Accordingly, the sealing member 15 provided to the coil case 10 is designed so that the first lip portion 15*a* is placed into close contact with inner and outer peripheral surfaces of the inner small annular groove 17*a*; the second lip portion 15*b* is placed into close contact with an inner peripheral surface of the large annular groove 17; and the fourth lip portion 15*d* is placed into close contact with an outer peripheral surface of the case lower portion 10*a* and an inner peripheral surface of the plughole 12. In addition, an annular raised wall 19 surrounding an upper opening of the plughole 12 is formed on the bottom surface of the recessed groove 5 of the head cover 2. The third lip portion 15*c* is designed to come into close contact with an outer peripheral surface of the raised wall 19.

As shown in FIGS. 5 to 10, the case upper portion 10*b* is provided with a longitudinal air path 21 extending upward from a portion of the outer small annular groove 17*b*. A vent hole 27 communicating with the longitudinal air path 21 is provided in an upper portion of the case upper portion 10*b*. A cover wall 22 hanging toward an upper surface of the engine E and surrounding the vent hole 27 is continuously and integrally provided to the case upper portion 10*b*. The cover wall 22 defines an air chamber 20 inside thereof. The vent hole 27 is opened in a ceiling surface of the air chamber 20, and the entire bottom of the air chamber 20 faces the engine E and is opened to ambient air, so that an opening face 20*a* is formed. The cover wall 22 is formed on a side portion which is an opposite side of the case upper portion 10*b* from the bracket 11.

The air chamber 20 and the longitudinal air path 21 adjacent thereto inside are formed by mold releasing from a lower surface side, of the coil case 10, facing the bottom surface side of the recessed groove 5, at the time of forming the coil case 10. In order to facilitate the mold releasing, a draft angle (see FIG. 6) θ is provided to an inner side surface of the air chamber 20. This means that the air chamber 20 has its cross-sectional area gradually increased toward the opening face 20*a* formed in the lower portion of the air chamber 20.

The air chamber 20 has a larger volume than an amount of air taken one time by the plughole 12 as the temperature of the engine E ordinarily changes.

The air chamber 20 and the longitudinal air path 21 have a ceiling wall 23 integral with the case upper portion 10*b* which closes upper surfaces of the air chamber 20 and the longitudinal air path 21. The ceiling wall 23 is provided with the vent hole 27, a swelled chamber 26 to which an inner end of the vent hole 27 is opened, and a throttle hole 28 which connects the swelled chamber 26 and the longitudinal air path 21. The vent hole 27 and the longitudinal air path 21 are communicated with each other via the swelled chamber 26 and the throttle hole 28.

A mold-release hole 29 for forming the swelled chamber 26 is opened to an outer side surface of the ceiling wall 23. A closure body 30 for closing the mold-release hole 29 is fixedly attached to the mold-release hole 29 by press fitting, adhering, depositing or the like.

The vent hole 27 and the throttle hole 28 are formed by mold releasing together with the air chamber 20, the longitudinal air path 21, and the swelled chamber 26. In the mold releasing, multiple reinforcing ribs 31 linking inner walls of the air chamber 20 which face each other are formed on the ceiling surface of the air chamber 20.

Meanwhile, a lower end portion of the longitudinal air path 21 communicates with the plughole 12 via a communicating path 25. The communicating path 25 is formed of an outer annular path 35, an outer longitudinal groove 36, an inner annular path 37, and an inner longitudinal groove 38. The outer annular path 35 is defined by the outer small annular groove 17*b* and the sealing member 15, the outer small annular groove 17*b* being arranged to communicate with the lower end of the longitudinal air path 21. The outer longitudinal groove 36 is formed in an inner peripheral surface of the annular separation wall 18 with which the first lip portion 15*a* comes in close contact, the outer longitudinal groove 36 communicating with the outer annular path 35. The inner annular path 37 is defined by the inner small annular groove 17*a* and the first lip portion 15*a*, and communicates with the outer longitudinal groove 36. The inner longitudinal groove 38 is formed in the outer peripheral surface of the case lower portion 10*a*, with which the fourth lip portion 15*d* comes in close contact so that the inner annular path 37 communicates with the plughole 12. The outer longitudinal groove 36 and the inner longitudinal groove 38 are arranged at different positions (see FIG. 5) from each other in the peripheral direction of the coil case 10. As described above, the communicating path 25 has a maze-shaped structure. In addition, the outer annular path 35 is set to have the largest volume in the communicating path 25.

Next, a description is given of operations of this embodiment.

When the engine temperature is increased or decreased as the engine E is operated and stopped repeatedly, the plughole 12 breathes accordingly. The plughole 12 communicates with the vent hole 27 opened to the air chamber 20 via the swelled chamber 26, the throttle hole 28, the longitudinal air path 21, and the communicating path 25 (the outer annular path 35, the outer longitudinal groove 36, the inner annular path 37, and the inner longitudinal groove 38), and thus can smoothly take in and out air in the air chamber 20, that is, the atmospheric air, through the vent hole 27.

Meanwhile, the vent hole 27 is provided in the upper portion of the case upper portion 10*b*, and the cover wall 22 hanging toward the upper surface of the engine E and surrounding the vent hole 27 is continuously formed on the case upper portion 10*b*. For this reason, the cover wall 22 can prevent water from entering the vent hole 27 when the case upper portion 10*b* receives the water such as splashed water entering the engine room during driving on a flooded road or a road having a puddle, rainwater entering the engine room during driving on a rainy day, washing water entering the engine room at the time of washing a car, or the like.

In addition, the air chamber 20 is formed inside the cover wall 22. In the air chamber 20, the vent hole 27 is opened in the upper portion of the air chamber 20 and the bottom of the air chamber 20 forms the opening face 20*a* which is opened toward the engine E. Accordingly, even when water entering the engine room forms a pool in the recessed groove 5 in the upper surface of the engine E, and the opening of the air chamber 20 is closed by the pool, air in the air chamber 20 prevents the water level from rising, and thus prevents the water from entering the vent hole 27.

On top of that, the entire bottom of the air chamber 20 is formed into the opening face 20*a* which is opened toward the engine E. When the water in the pool drains, water in the air chamber 20 simultaneously flows away through the opening face 20*a* without any resistance and drains together with the water in the pool. Thereby, the air chamber 20 can be evacuated immediately. This means that even when the engine E receives water repeatedly, water entering the air chamber 20 does not stay therein. Accordingly, even if the plughole 12 takes air with the decrease of the temperature of the engine E, it is possible to prevent the plughole 12 from taking water through the vent hole 27.

In addition, since the air chamber 20 is formed in such a manner that the cross-sectional area thereof is gradually increased toward the opening face 20*a*, the air chamber 20 has the largest cross-sectional area in the opening portion thereof. This allows water to flow from the air chamber 20 more swiftly. Moreover, mold releasing from the air chamber 20 can be facilitated at the time of forming the coil case 10.

Further, the vent hole 27 communicates with the longitudinal air path 21 via the throttle hole 28 and the swelled chamber 26 which are formed in the ceiling wall 23 of the longitudinal air path 21 and the air chamber 20. In the unlikely event that water drops having momentum and entering the air chamber 20 pass through the vent hole 27, a pressure decrease effect in the swelled chamber 26 attenuates the momentum of the water drops, thereby reliably preventing the water drops from entering the longitudinal air path 21 through the throttle hole 28.

Further, when the coil case 10 is formed, the vent hole 27, the swelled chamber 26, and the throttle hole 28 can be formed simultaneously with the air chamber 20 and the longitudinal air path 21. This facilitates the forming of the coil case 10. On top of that, the mold-release hole 29 for forming the swelled chamber 26 can be closed with the closure body 30.

Moreover, the annular sealing member 15 for closing the upper opening portion of the plughole 12 is provided between the case lower portion 10*a* and the case upper portion 10*b* of the coil case 10. Thus, the sealing member 15 prevents water received by the engine E from directly entering the plughole 12.

Furthermore, by utilizing the sealing member 15, the communicating path 25 communicating between the longitudinal air path 21 and the plughole 12 is formed between the sealing member 15 and the coil case 10. The communicating path 25 forms a complicated maze which has many bent portions and is formed by the outer annular path 35, the outer longitudinal groove 36, the inner annular path 37, and the inner longitudinal grove 38. For this reason, even though moisture is contained in the atmospheric air which is taken by the plughole 12 at the time of breathing, the moisture can be separated from the air because the moisture collides with the many bent walls in the maze. This can prevent the moisture from entering the plughole 12.

Besides, the outer longitudinal groove 36 which is continuous to the plughole 12 side extends upward from the outer annular path 35 communicating with the lower end portion of the longitudinal air path 21. In the unlikely event that water passing through the air chamber 20 enters the longitudinal air path 21, the water is held by the outer annular path 35. Thereby, it is possible to prevent the water from moving to the outer longitudinal groove 36 side, that is, to the plughole 12 side. In this case, water remaining in the outer annular path 35 naturally evaporates as the plughole 12 breathes.

The present invention is not limited to the above-mentioned embodiment and may be modified in a variety of ways as long as the modifications do not depart from its gist.

What is claimed is:

1. A plughole waterproofing device for an engine comprising:

a coil case for covering an ignition coil, the coil case is configured to be fitted onto the ignition coil that is accommodated, together with an ignition plug, in a plughole opened to an upper surface of an engine, wherein a longitudinal air path and a vent hole are provided in an upper portion, configured to protrude above the engine, of the coil case, the longitudinal air path extending upward from a lower end portion of the case upper portion communicating with the plughole, the vent hole communicating with an upper end portion of the longitudinal air path and being opened to ambient air, wherein the vent hole is provided in an upper portion of the case upper portion, wherein a cover wall is continuously provided on the case upper portion, the cover wall configured to hang toward the upper surface of the engine while surrounding the vent hole, wherein an air chamber is formed inside the cover wall, the vent hole being opened in an upper portion of the air chamber, an opening face being formed at an entire bottom of the air chamber in such a manner as to open downwardly, and wherein the air chamber is formed in such a manner that a cross-sectional area of the air chamber is gradually increased toward the opening face.

2. The plughole waterproofing device for an engine according to claim 1, wherein a swelled chamber to which an inner end of the vent hole is opened and a throttle hole through which the swelled chamber communicates with the upper end portion of the longitudinal air path are provided in the upper portion of the case upper portion, so that the vent hole and the longitudinal air path are communicated with each other.

3. The plughole waterproofing device for an engine according to claim 2, wherein a mold-release hole for forming the swelled chamber is provided in the case upper portion and closed by a closure body.

4. The plughole waterproofing device for an engine according to claim 1, further comprising an annular sealing member configured to be placed into close contact with an upper opening portion in the plughole is fitted into the coil case, wherein an outer annular path, an outer longitudinal groove, an inner annular path, and an inner longitudinal groove are formed between the sealing member and the coil case, so that the longitudinal air path and the plughole are communicated with each other, the outer annular path communicating with a lower end of the longitudinal air path, the outer longitudinal groove extending upward from the outer annular path, the inner annular path being connected to an upper end portion of the outer longitudinal groove and arranged inward of the outer annular path, and the inner longitudinal groove communicating between the inner annular path and the plughole, at a position different from that of the outer longitudinal groove, on a circumference of the coil case.

5. The plughole waterproofing device for an engine according to claim 1, wherein the case upper portion and the cover wall are formed together by molding.

* * * * *